US006948588B1

(12) United States Patent
Chustak

(10) Patent No.: US 6,948,588 B1
(45) Date of Patent: Sep. 27, 2005

(54) TRACK AND HINGE FOR A BOAT LADDER

(76) Inventor: Daniel A. Chustak, 602 E. Eckman St., South Bend, IN (US) 46614

( * ) Notice: Subject to any disclaimer, the term of this patent is extended or adjusted under 35 U.S.C. 154(b) by 0 days.

(21) Appl. No.: 10/813,705

(22) Filed: Mar. 31, 2004

(51) Int. Cl.[7] ..... E04G 3/00; E06C 9/00
(52) U.S. Cl. ..... 182/97; 182/88; 114/362
(58) Field of Search ..... 182/97, 91, 127, 182/36, 39, 88, 38, 194, 82; 114/362

(56) References Cited

U.S. PATENT DOCUMENTS 2,611,466 A * 9/1952 Biggert et al. ..... 182/97
3,539,033 A * 11/1970 Schwarz et al. ..... 182/97
4,724,925 A * 2/1988 Ritten ..... 182/97
4,846,303 A 7/1989 Cooper
5,044,465 A 9/1991 Rinke
5,117,940 A * 6/1992 Garelick ..... 182/97
5,427,049 A 6/1995 Mardikian
5,617,930 A * 4/1997 Elia ..... 182/97
5,887,540 A 3/1999 Krish
5,970,905 A * 10/1999 Jaramillo, Sr. ..... 114/362
6,021,733 A * 2/2000 Jaramillo, Sr. ..... 114/362
6,058,875 A * 5/2000 Krish, Jr. ..... 114/362
6,345,691 B1 * 2/2002 Ruiz ..... 182/127

* cited by examiner

*Primary Examiner*—Hugh B. Thompson II
(74) *Attorney, Agent, or Firm*—Leo H McCormick, Jr.

(57) ABSTRACT

A ladder system through which a ladder is retained on a deck of a watercraft by a track arrangement and positioned at a first location in an opening for an enclosure where the ladder is substantially vertical to the side of the watercraft to permit ingress/egress of a person between a body of water and the deck. The ladder is connected to a rail of the track arrangement by a first and second hinges that permits the ladder to be rotated from the vertical position along the side of the watercraft to a position inside of the enclosure. The ladder may thereafter be moved from the opening to a location adjacent the gate and behind the enclosure to conceal and stow the ladder such that the exterior surface of the watercraft along the enclosure is substantially uniform from stem to stern.

14 Claims, 4 Drawing Sheets

TRACK AND HINGE FOR A BOAT LADDER

This invention relates to a track through which a ladder is attached to a deck to allow egress from a body of water into a water craft and whereby the ladder is hidden behind an enclosure when the water craft is traveling through the body of water.

BACKGROUND OF THE INVENTION

Pontoon boats are a popular watercraft with many people as they can be used for many different activities such as fishing, trolling, tubing, skiing, cruising and mooring. The decks for pontoon boats most often provided with an enclosure that extends about 2–3 feet above the deck to offer protection against stepping into the water or being ejected into the water during movement of the boat in a body of water. The enclosure has at least one and more often two gates to allow a person to directly walk from a pier onto the deck with gate matching the enclosure such that a uniform appearance is provided from the front to the rear of the boat. A popular activity for the use of a pontoon boat is to moor in a body of water and allow the deck to be used as a platform for swimmers. A ladder may be provided for a swimmer to move from the water onto the deck. It is common for such a ladder to be stored in seat furniture located on the deck and when needed the ladder is attached to catches mounted in a gateway of the enclosure. When the ladder is located in the gateway, the gate can not be closed and it is possible that ladder may be dislodged from the deck by a wave created by another boat passing the moored watercraft and as a result a ladder often sinks to the bottom the body of water. Unfortunately, a ladder stored inside a seat is often not accessible from the water and nor convenient for speedy installation in the gateway. U.S. Pat. No. 4,846,303 and U.S. patent application Ser. No. 10/772,125 disclose ladder structure that is attached to the exterior surface of the deck and moved in a track between an up position adjacent the gate and a down position inline with the gate. While this type structure functions in an adequate manner, a track may be damaged if the watercraft should engage the dock at a high speed. In addition, since the ladder and track is located on the exterior of the deck some boat owners have a concern that it detracts from the overall sleek appearance of the watercraft.

SUMMARY OF THE INVENTION

The track and hinge arrangement of the present invention provides an ability for a ladder to be moved behind an enclosure on the deck of a water craft when the ladder is in an up position and allows the ladder to slide in a rail to an inline location with respect to a gate in the enclosure and rotated 180° to a down position and permit ingress/egress between the deck and a body of water.

According to this invention, the track and hinge arrangement is characterized by a rail having a length that extends from a first end located on the deck adjacent the opening of the gate for the enclosure to a second end located on the deck a fixed distance past the opening. The rail has an axial space that extends from the first end to the second end with an axial slot that is located in a top surface of the rail. The axial slot extends the exterior surface into the axial space from the first end to the second end with a dimension that is smaller than a width of the axial space such that first and second lips are defined along top surface of the rail. The rail has a uniform shape and forms a threshold in the opening of the gate such that it does not interior with walking through the gage. A first connector has a first head that is located in the axial space with a first shaft that extends through the axial slot that is connected to a first strap of a first hinge member and a second connector has a first head that is located in the axial space with a first shaft that extends through the axial slot that is connected to a first strap of a second hinge member. The first strap of the first hinge is connected to a second strap by a first pin while the first strap of the second hinge is connected to a second strap by a second pin. The second strap of the first hinge is connected to a first leg of the ladder and the second strap of the second hinge is connected to a second leg of the ladder. The first straps are aligned in a horizontal position with respect to the deck while the first and second pins allow the second straps to pivot between the up and down positions to allow the ladder to be moved between a first vertical position adjacent inside of the side rail to a second vertical position adjacent the outside of the side rail. When the ladder is an up position it may be moved in the rail past the gate to be hidden behind the side rail and as a result does not detract from the external appearance of the watercraft. In addition, once the ladder is deployed in the down position, the gate may be closed and as a result any children could move about the deck and be protected from accidentally stepping into the water.

An advantage of this invention resides in rail for a track arrangement that is located on a horizontal surface of a deck whereby a gladder may be moved to a location on the deck and stored adjacent an enclosure so as not to effect an external appearance of the water craft.

A further advantage of this invention resides in the ability to stow a ladder arrangement on a deck behind an enclosure of a watercraft when not in use and to move the ladder to an opening in the enclosure when it is desired to provide egress from a body water.

A further advantage of this invention resides in the positioning of the ladder along the side rather than on the rear such that the driver of a boat can have eye to eye contact with a person in the water or skiing behind the boat and there is a reduction in the possible contact with a propeller of boat.

DETAILED DESCRIPTION

Throughout the specification when a same component is used in more than one location it may be described only once but will be identified by the number plus when necessary for use in the other location.

Figure 1:
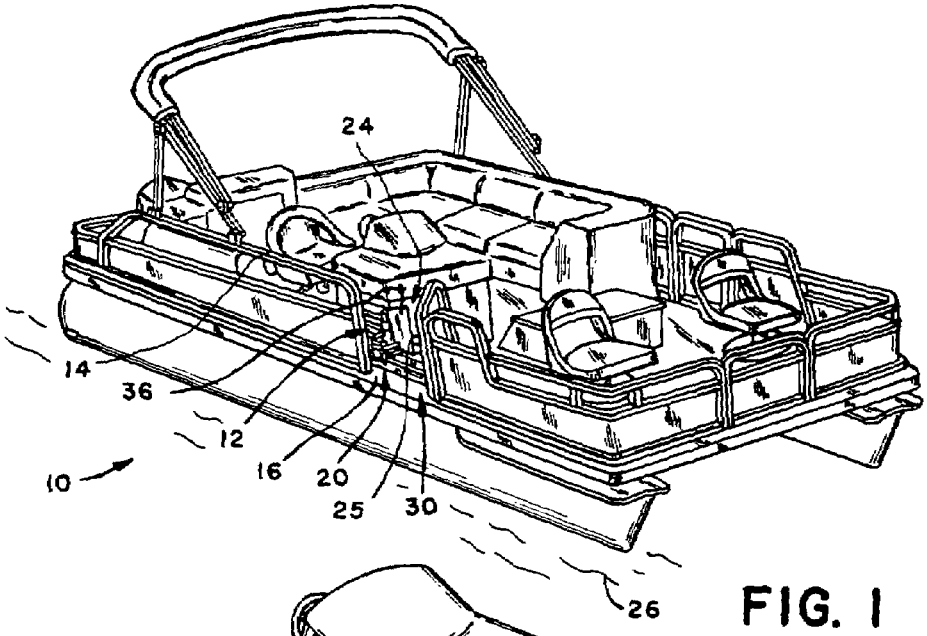
FIG. 1 is a schematic of a watercraft with a track and hinge arrangement made according to the principles of this invention whereby ladder that is stowed in pocket of a control station behind the enclosure on a deck may be moved to an opening in the enclosure whenever a person desire may climb from a body of water onto the deck.
Figure 4:
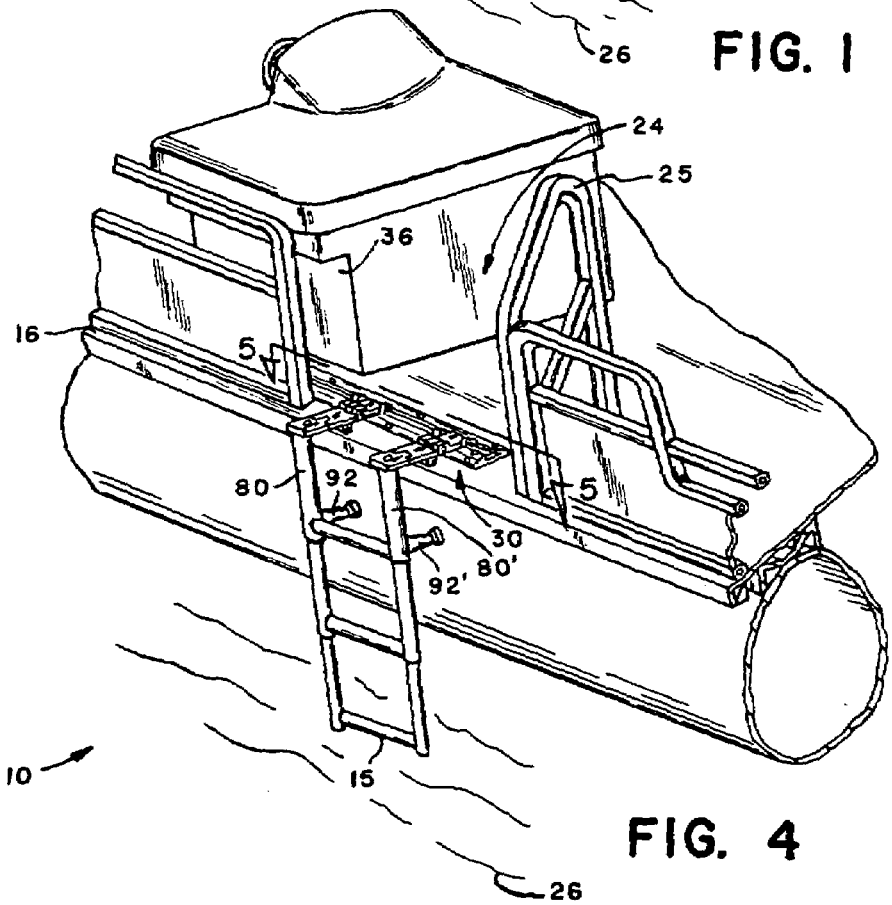
FIG. 4 is a schematic view of FIG. 2 wherein the ladder has with the ladder has been rotated from the down position to allow ingress/egress between the deck and the body of water.
Figure 3:
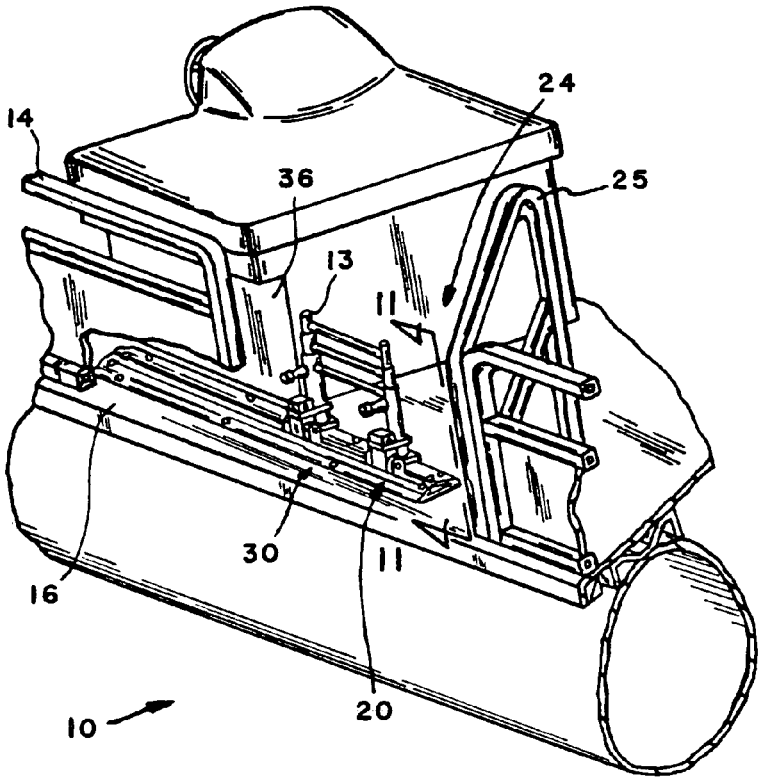
FIG. 3 is a schematic view of FIG. 2 wherein the ladder has been moved to the opening in the enclosure.
Figure 2:
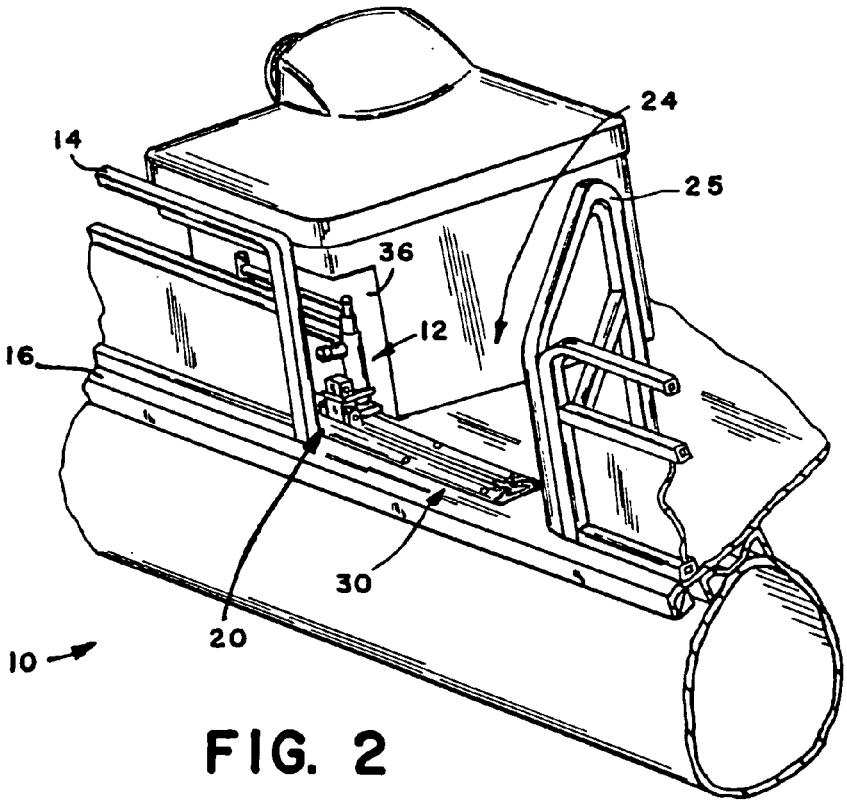
FIG. 2 an enlarged schematic view of the opening in the enclosure of FIG. 1.

FIGS. 1 and 2 provide a schematic illustration of a watercraft 10 having a ladder 12 that is located in a pocket 36 behind an enclosure 14 on the deck 16 in accordance with the present invention. The ladder 12 is retained on the deck 16 by a track and hinge arrangement 20 that is attached to the deck 16 in a manner that the ladder 12 may be moved from the pocket 36 behind the enclosure 14 to a position in alignment with an opening 24 of a gate 25 in the enclosure 14 as shown in FIG. 3 and rotated from an up position to a down position as shown in FIG. 4 to permit ingress/egress from a body of water 26 onto the deck 16. The ladder 12 is designed to be retracted and stowed as shown in FIGS. 1 and 2 when the watercraft is moving in the body of water 26 and as a result does not impede the travel through the body of water 26 but when the watercraft 10 is in a moored situation the ladder 12 may be moved to the opening 24 and extended into the body of water 26 as shown in FIG. 4.

Figure 9:
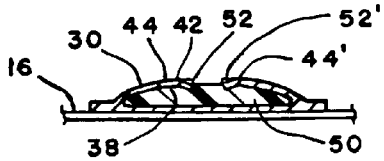
FIG. 9 is a sectional view taken along lines 9—9 of FIG. 5.

The track and hinge arrangement 20 is best illustrated in detail in FIGS. 5–11 and is characterized by a rail 30 having a length that extends from a first end 32 that is located on the deck 16 adjacent an opening 24 for gate 25 to a second end 34 that is located on the deck 16 a fixed distance past the opening 24 and into pocket 36 in the control station of the watercraft 10. The rail 30 has an axial cross-sectional space as shown in FIG. 9 that extends from the first end 32 to the second end 34 with an axial slot 40 along a top surface 42 that extends into the axial space 38 from the first end 32 to said second end 34. The axial slot 40 has a dimension that is smaller than a width of the top surface 42 such that first 44 and second 44' lips are defined along the top surface 42 of the rail 30 with respect to the axial space 38.

Figure 10:
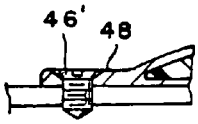
FIG. 10 is a sectional view taken along lines 10—10 of FIG. 5.
Figure 8:
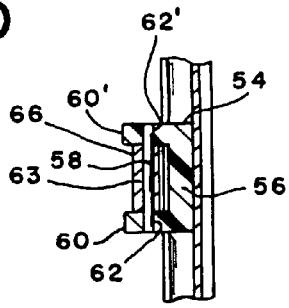
FIG. 8 is a sectional view taken along lines 8—8 of FIG. 5.
Figure 6:
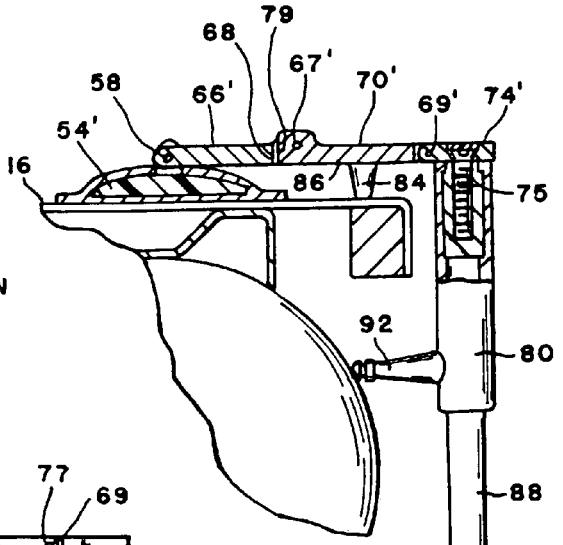
FIG. 6 is a partial sectional view taken along lines 6—6 of FIG. 5.
Figure 7:
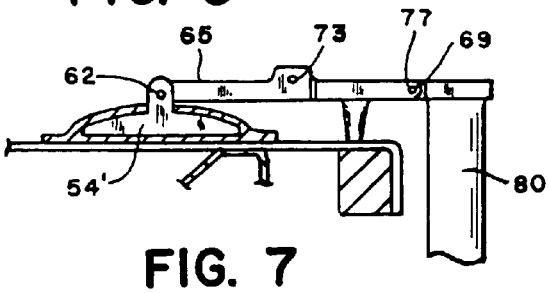
FIG. 7 is a sectional view taken along lines 7—7 of FIG. 5.

The rail 30 is attached to the deck 16 by a plurality of screws 46, 46' . . . 46" that extend through the edge surfaces 48,48' as shown in FIG. 10, to define a threshold which has a height of about one inch with an essentially dome shape such that it would not form an obstruction for a person walking though the opening 24 for gate 25. End stops 50,50' are located in the axial space 38 and tabs 52,52', 53,53' crimped such the movement within the axial space 38 is restricted to a distance between the first end 32 and second end 34. The axial space 38 is designed to receive first 54 and second 54' connectors that may be moved between the first 32 and second ends 34 of the rail 30. The first 54 and second 54' connectors are identical as best shown in FIGS. 6,7 and 8 and only the first connector 54 will be described in detail. Connector 54 is defined a body 56 that has a shape that is concentric to the axial space 38 and yet will permit movement between the first end 32 and second end 34. Body 56 has a projection defined by arms 60,60' that extend through the axial slot 38. Arms 60,60' have respective openings 62,62' located therein such as on movement of body 56 within the axial slot 38 the openings 62,62' are in parallel alignment with the axis of a axial slot 40.

Figure 5:
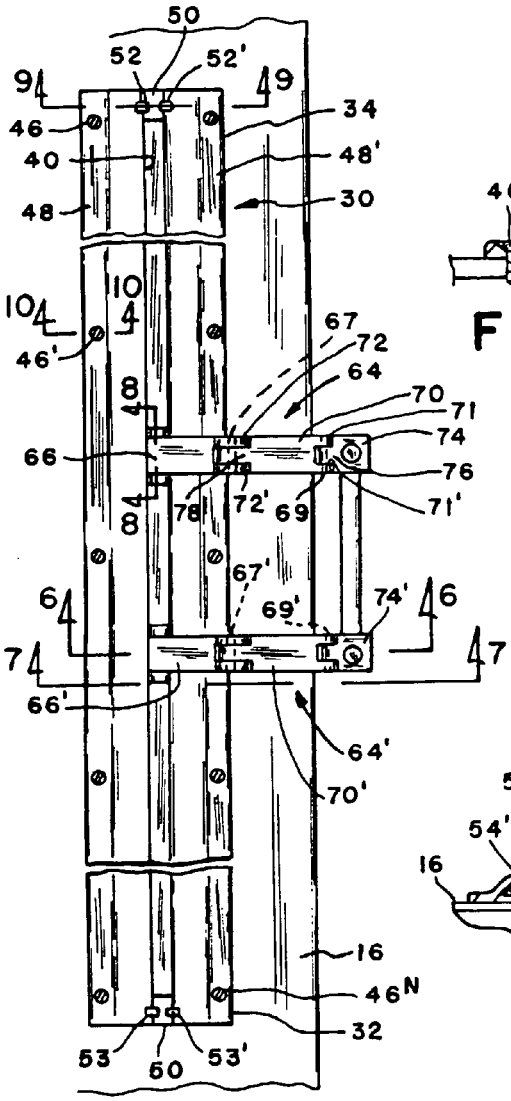
FIG. 5 is a schematic view of a track and hinge arrangement taken along lines 5—5 of FIG. 4.

Bodies 56, 56' are designed to be respectively connected to first 64 and second 64' hinge members that will allow the ladder 12 to pivot on pin 58 about openings 62,62' in connectors 54,54'. The first 64 and second 64' hinge members are identical and are best illustrated in FIGS. 5,6 and 7.

Hinge member 64 is defined by a first strap 66, a second strap 70 and a third strap 74 with the first strap 66 being connected to arms 60,60' on connector 54 that extends through axial slot 40 by a pin 58 that extends through opening 63 and to the second strap 70 by a pin 67 while the second strap 70 is connected to the third strap 74 by a pin 69. The first strap 66 has first 72 and second 72' projections thereon that define a fork to receive a tongue 78 on the end of the second strap 70. The projections 72,72' have respective openings 73,73' that are in alignment with the top surface 65 of the first strap 66 such that when pin 67 extends through openings 73,73' in the first 72 and second 72' projections and on flat surface 79 on tongue 78 engaging flat surface 68 on strap 66 the rotation of the second strap 70 with respect the first strap 66 is stopped to create an essentially parallel horizontal extension thereof. The second strap 70 has first 71 and second 71' projections thereon that define a fork thereon to receive a tongue 76 on the third strap 74. The first 71 and second 71' projections have respective center openings 77 therein that are in line with the opening 63 in the first strap 66. Pin 69 extends through the openings 77,77' in the first 71 and second 71' projections and through the tongue 76 such that the third strap 74 may pivot without restraint with respect to the second strap 70. The third strap 74 is fixed to a leg 80 of ladder 12 by a screw 75. The second strap 70 is further defined by a button 84 that is attached to bottom surface 86 and may be located adjacent pin 69 that is designed to engage deck 16 to assist in maintaining the parallel horizontal alignment between the first 66 and second 70 straps.

The first 64 and second 64' hinge member respectively connect the first 80 and second 80' legs of the ladder 12 to the connectors 54,54' retained in rail 30 to permit movement of the ladder 12 between an up and down position with respect the an opening 24 in an enclosure 14 and for movement to a storage location behind the enclosure 14 in a pocket 36 adjacent to or in the control station.

Figure 12:
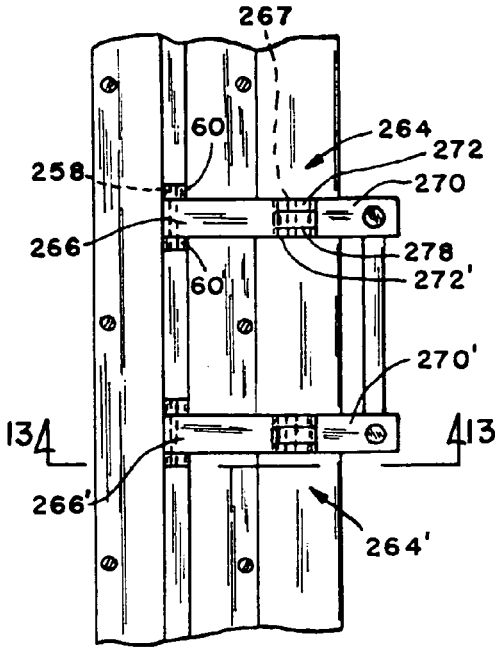
FIG. 12 is a schematic view of a second track and hinge arrangement for a ladder of FIG. 1.
Figure 14:
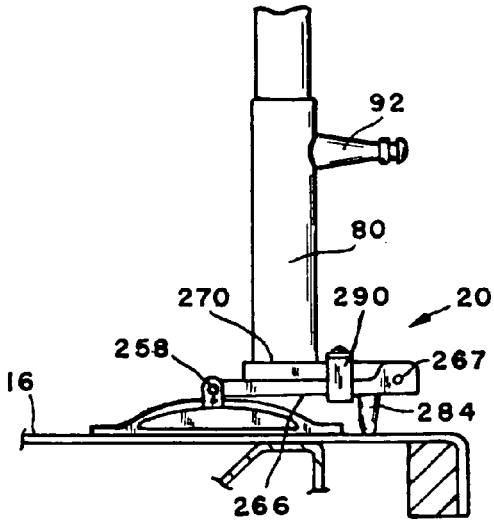
FIG. 14 is a sectional view of the track and hinge arrangement of FIG. 12 showing the ladder in an up position.
Figure 13:
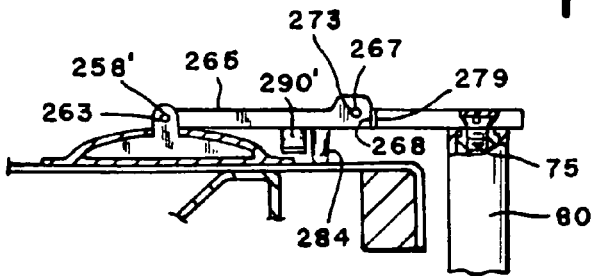
FIG. 13 is a partial sectional view taken along lines 13—13 of FIG. 12 showing a ladder in a down position with respect to a deck of a watercraft.

A second embodiment of the hinge member 264 is illustrated for the track and hinge arrangement 20 in FIGS. 12,13 and 14. The hinge member 264 is identical for both legs 80,80' of ladder and as a result the description applies equally when used with either leg. The hinge member 264 is defined by a first strap 266 and a second strap 270 with the first strap 266 being connected to arms 60,60' on connector 54 by a pin 258 that extends through opening 263 and to the second strap 270 by a pin 267. The first strap 266 has first 272 and second 272' projections thereon that define a fork to receive a tongue 278 on the end of the second strap 270. The projections 272,272' have respective openings 273,273' that are in line with the top surface 265 of the first strap 266 that receive pin 267 that extends through the projections 272, 272'. When the flat surface 279 on tongue 278 engages flat surface 268 on strap 266 the rotation of the second strap 270 with respect the first strap 266 is stopped to essentially provide a parallel horizontal extension thereof. The first strap 266 has a length between pin 258 to the end of projections 272,272' is less that a length between pin 258 and an inside surface of the enclosure 14. The end of the second strap 270 is secured to the leg 80 by a screw 75 while a button 284 is fixed to the bottom of the first strap 266 that is designed to engage deck 16 when the ladder 12 is in the down position to assist in maintaining the first 266 and second 270 straps in a horizontal position when the ladder 12 is in a vertical position with respect to deck 16 as illustrated in FIG. 13.

MODE OF OPERATION OF THE INVENTION

Figure 11:
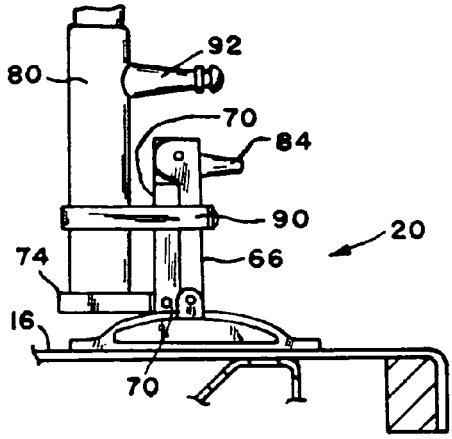
FIG. 11 is an enlarged partial sectional view taken along lines 11—11 of FIG. 3.

During travel of the watercraft 10 in a body of water, ladder 12 would normally be stowed in pocket 36 of the control station, as illustrated in FIGS. 1 and 2. With the ladder in the stowed location, the external appearance of the watercraft is sleet and uniform from the stem to stern and does not impede the movement of the watercraft within the body of water. When an operator desires to moor the watercraft in the body of water and provide for ingress/egress between deck 16 and the body of water, the ladder 12 is moved from the pocket 36 to a position that is in alignment with opening 24 in gate 25, as illustrated in FIGS. 3 and 11. Restraining straps 90,90' are undone and the end 13 of ladder 12 rotated from a vertical position that extends perpendicular to deck 16 to a vertical position that is vertical with the side of the watercraft 10 as illustrated in FIG. 6. The ladder 12 is of a type having a telescoping sections 88, 88' . . . 88" such that rung 15 on end 13 is located in the body of water 26 at least a distance of twelve inches as required by marine safety regulations. The first section 88 of ladder 12 has a standoff 92,92' that engage the side of the watercraft to maintain the ladder 12 in the vertical position with respect to the side of the watercraft. In this position, buttons 84,84' engages deck 16 such that the first strap 66 and second strap 70 are in a horizontal plane with respect to the deck 16 and remain in this position and forces that are produced when a person steps on the rungs 15,15" on the ladder 12 are carried into the connectors 54,54' and uniformly distributed in the rail 30.

When the operator desires to terminate the mooring situation, it is desirable to return the ladder 12 to the stowed location. Initially the ladder 12 is rotated from the down position illustrated in FIG. 4 to the position illustrated in FIG. 3 where the first strap 66, second strap 70 of hinges 64,64' and first 80 and second 80' legs of the ladder 12 section 88 are in a vertical with respect to deck 16 and perpendicular to the third straps 74 of the hinges 64,64'. The restraining straps 90,90' are respectively wrapped around the first 80 and second 80' legs and the first 66 and second 70 straps to align the ladder in a second vertical position with respect to deck 16. The ladder 12 may now be moved from a position in line with the opening 24 in gate 25 to the pocket 36 by sliding connectors 54,54' in the axial space 38 in rail 30. With the ladder in pocket 36, gate 25 in the enclosure 14 can be closed to provide an interrupted external appearance for the watercraft 10 as the ladder 12 is hidden from the view outside of the watercraft.

For some applications, it may be desirable for the ladder 12 to be stowed in a horizontal position with respect to the deck 16 and it this situation, the second strap 70 is folded onto the top of strap 66 and strap 74 pivoted on pin 69 to bring legs 80,80' into parallel alignment with the deck 16 and the ladder 12 would be moved into a substantially horizontal is pocket behind the enclosure 14.

The embodiment of the track and hinge arrangement 20 having a hinge arrangement 264 functions in an overall manner as described above for hinge arrangement 64 to conceal a ladder 12 behind the enclosure 14 except for the manner in which the ladder 12 is rotated between the up and down positions with respect to the deck 16. In this arrangement, the ladder 12 is moved from the stowed position to the center of the opening 24 for gate 25. The retainer straps 290 are removed from around the first strap 266 and second strap 270 and the end 13 of ladder 12 is pivoted about pin 267 until stop 284 engages deck 16 and ladder 12 is in a vertical position with respect to the side of the watercraft 10 to permit ingress/egress between the deck 16 and the body of water 26. When it is desired to remove the ladder 12 from the position adjacent the side of the watercraft 10, the ladder is pivoted on pin 267 and the second strap 270 is brought into essentially parallel alignment on the top of the first strap 266 as shown in FIG. 14. The retaining straps 290 are placed around the first 266 and second 270 straps such that the legs 80,80' of the ladder 12 are in a vertical position above the deck 16. It should be noted that the legs 80,80' of the ladder 12 are off-set some what from the axial slot 40 in rail 30 a length that is dependent on a length of the first strap 266 and the hold-off 92,92' for the ladder 12 such that on movement to the stowed posit ion adjacent the opening 24 a desired clearance is achieved with the enclosure 14. Once in a vertical position as illustrated in FIG. 14, the ladder 12 may now be moved by sliding the connectors 54,54' in the axial space 38 of rail 30 to a stowed position that is behind the enclosure 14 to hide or conceal the ladder 12 from view outside of the watercraft 30.

I claim:

1. A ladder system through which a ladder is retained on a deck of a water craft by a track arrangement and the ladder is aligned in a first location that is substantially vertical to a gate in an enclosure to permit egress of a person from a body of water onto the deck and said ladder is rotatable 180° from a first position to a second position that is substantially vertical to a side rail and the ladder is movable from the first location to a second location adjacent the gate for storage, said track arrangement being characterized by a rail having a length that extends from a first end that is located on the deck adjacent an opening for the gate to a second end that is located on the deck a fixed distance past the opening, said rail having an axial space that extends from said first end to the second end with an axial slot along a top surface of said rail that extends into said axial space from said first end to said second end, said axial slot having a dimension that is smaller than a width of said axial space such that first and second lips are defined along said top surface of said rail; a first hinge member having a first pin through which a first strap is connected to a second strap and a second pin through which the second strap is connected to a third strap; a first connector having a first head that is located in said axial space with a first projection that extends from said first head through said axial slot, said first strap of said first hinge member being secured to said first projection while said third strap of said first hinge member is secured to a first leg of said ladder; a second hinge member having a third pin through which first fourth strap is connected to a fifth strap and a fourth pin through which the fifth strap is connected to a sixth strap; and a second connector having a second head that is located in said axial space with a second projection that extends from said second head through said axial slot, said fourth strap of said second hinge member being secured to said second projection while said sixth strap of said second hinge member is secured to a second leg of said ladder, said first strap of said first hinge member and said fourth strap of said second hinge member members remaining stationary when said ladder is rotated from the first position to the second position such that said second strap of said first hinge member and said fourth strap of said second hinge member respectively pivot on said first and third pins to align said second and third straps over said first strap and said fifth and sixth straps over said third strap and thereby bring said ladder into vertical alignment in a plane that is adjacent the side rail such that on movement of said ladder to the second location, the ladder is behind the enclosure and thereby hidden from view.

2. The ladder system as recited in claim 1 wherein said second strap of said first hinge member and said fifth strap of said second hinge member are each is further characterized by a first stop to maintain said second strap in a substantial horizontal plane with respect to said first strap and said fifth strap in a substantial horizontal plane with respect to said fourth strap when said ladder is in the first position.

3. The ladder system as recited in claim 2 wherein said second strap and said fourth strap are each further characterized by a button located adjacent said second pin that engages the deck when said ladder is in the first position to assist in maintaining the horizontal position.

4. The ladder system as recited in claim 3 wherein said second strap and said fourth strap are each further characterized by a second stop that engages said third strap to limit the lateral movement of said ladder with respect to the horizontal position.

5. The ladder system as recited in claim 4 further including retainer means the that aid in keeping said second and third straps of said first hinge member and fifth and sixth straps of said second hinge member and said first and second legs of said ladder in the vertical plane.

6. A ladder system through which a ladder is retained on a deck of a water craft by a track arrangement and wherein said ladder is aligned in a first location that is substantially vertical to a gate in an enclosure to permit egress of a person from a body of water onto the deck and wherein said ladder is rotatable 180° from a first position to a second position that is substantially vertical to the enclosure to allow said ladder to be moved from the first location to a second location adjacent the gate for storage, said track arrangement being characterized by a rail having a length that extends from a first end located on the deck adjacent an opening for the gate to a second end located on the deck a fixed distance past the opening, said rail having an axial space that extends from said first end to the second end with an axial slot located in a top surface of said rail that extends into said axial space from said first end to said second end, said axial slot having a dimension that is smaller than a width of said axial space such that first and second lips are defined along said top surface of said rail; a first hinge member having a first pin through which a first strap is connected to a second strap; a first connector having a first head that is located in said axial space and a first projection that extends from said first head through said axial slot, said first strap being secured to said first projection while said second strap is secured to a first leg of said ladder; a second hinge member having a second pin through which a third strap is connected to a fourth strap; and a second connector having a second head that is located in said axial space and a second projection that extends from the second head through said axial slot, said third strap being secured to said second projection while said fourth strap is secured to a second leg of said ladder, said first strap of said first hinge member and said third strap of said second hinge member remaining in a vertical position when said ladder is rotated from said first position to said second position such that said second and fourth straps respectively pivot on said first and second pins to align said second and fourth straps over said first and third straps to bring said ladder into vertical alignment in a plane that is adjacent the enclosure such that on movement of said ladder to the second location, said ladder is hidden behind the enclosure.

7. The ladder system as recited in claim 6 wherein said second strap and said fourth strap are each further characterized by a first stop that respectively engage said first strap and said third strap to maintain said second and fourth straps in a substantial horizontal position with respect to said first strap and said third strap when the ladder is in said first position.

8. The ladder system as recited in claim 7 wherein said second strap and said fourth strap are further characterized by a button that extends therefrom and engages the deck when said ladder is in said first position to assist in maintaining said horizontal position.

9. The ladder system as recited in claim 8 wherein said first strap and said third strap are each characterized by a second stop that engages said second strap and said fourth strap to maintain said ladder in said vertical alignment when said ladder is in said second position.

10. The ladder system as recited in claim 9 wherein said first and second heads on said connectors slide within said axial space when said ladder is moved between the first and second locations on the deck.

11. The ladder system as recited in claim 10 further including retaining means that holds said second strap against said first strap when said ladder is in said second position.

12. A ladder system through which a ladder is retained on a deck of a water craft by a track arrangement and wherein said ladder is aligned in a first location that is substantially vertical to a gate in an enclosure to permit egress of a person from a body of water onto the deck and said ladder being rotatable from a first position to a second position inside of the enclosure to allow said ladder to be moved from said first location to a second location adjacent the gate for storage, said track arrangement being characterized by a rail having a length that extends from a first end located on the deck adjacent an opening for the gate to a second end located on the deck a fixed distance past the opening, said rail having an axial space that extends from said first end to the second end with an axial slot located in a top surface of said rail that extends into said axial space from said first end to said second end, said axial slot having a dimension that is smaller than a width of said axial space such that first and second lips are defined along said top surface of said rail; a first hinge member having a first pin through which a first strap is connected to a second strap; a first connector having a first head that is located in said axial space and a first projection that extends from said first head through said axial slot, said first strap being secured to said first projection while said second strap is secured to a first leg of said ladder; a second hinge member having a second pin through which a third strap is connected to a fourth strap; and a second connector having a second head that is located in said axial space and a second projection that extends from the second head through said axial slot, said third strap being secured to said second projection while said fourth strap is secured to a second leg of said ladder, said first strap of said first hinge member and said third strap of said second hinge member remaining in a vertical position when said ladder is rotated from said first position to said second position such that said second and fourth straps respectively pivot on said first and second pins to align said second and fourth straps over said first and third straps to bring said ladder into vertical alignment in a plane that is adjacent the enclosure such that on movement of the ladder to said second location, said ladder is hidden behind the enclosure.

13. The ladder system as recited in claim 12 wherein said second strap and said fourth strap are each further characterized by a first stop that respectively engage said first strap and said third strap to maintain said second and fourth straps in a substantial horizontal position with respect to said first strap and said third strap when said ladder is in said first position.

14. The ladder system as recited in claim 13 wherein said second strap and said fourth strap are further characterized by a button that extends therefrom and engages the deck when said ladder is in said first position to assist in maintaining said horizontal position.

* * * * *